United States Patent [19]

Velencei

[11] Patent Number: 4,682,570

[45] Date of Patent: Jul. 28, 1987

[54] INTERNAL COMBUSTION ENGINE (JV-1)

[76] Inventor: John Velencei, Daly Rd., Far Hills, N.J. 07931

[21] Appl. No.: 674,945

[22] Filed: Nov. 26, 1984

[51] Int. Cl.[4] ..... F02B 33/04

[52] U.S. Cl. ..... 123/73 PP; 123/73 A; 123/65 R

[58] Field of Search ..... 123/65 R, 65 VC, 65 V, 123/73 R, 73 A, 73 PP

[56] References Cited

U.S. PATENT DOCUMENTS

| | | | |
|---|---|---|---|
| 1,292,322 | 1/1919 | Hunt | 123/73 PP |
| 1,540,286 | 6/1925 | Roberts | 123/73 PP |
| 2,337,245 | 12/1943 | Jacklin | 123/73 PP |
| 2,516,708 | 7/1950 | Lugt | 123/73 PP |
| 2,572,768 | 10/1951 | Schneeberger | 123/73 PP |
| 3,971,297 | 7/1976 | Fox | 123/73 PP |
| 4,004,557 | 1/1977 | Acker | 123/73 PP |
| 4,066,050 | 1/1978 | Ford-Dunn | 123/73 PP |

FOREIGN PATENT DOCUMENTS

| | | | |
|---|---|---|---|
| 0159918 | 10/1982 | Japan | 123/73 A |
| 362453 | 12/1931 | United Kingdom | 123/65 W |

*Primary Examiner*—Carl Stuart Miller

*Attorney, Agent, or Firm*—Jack B. Murray, Jr.

[57] ABSTRACT

An internal combustion engine cylinder assembly comprising an elongated cylinder having substantially vertically disposed interior walls defining an elongated firing chamber therein; piston means housed within the firing chamber and adapted for vertical reciprocation within the firing chamber; gas inlet channels in the lower portion of the firing chamber; a crankcase housing having a gas compression chamber disposed therein; a reed valve means pivotally secured to the inner walls of the gas compression chamber and adapted for passing fuel-/air mixtures into the gas compression chamber upon the depressuring thereof; a cylinder closure means positioned at the upper end of the cylinder defining the upper end of the firing chamber and being provided with exhaust gas valve means, adapted for cyclic opening and closing to alternatively permit the removal of exhaust gases from the firing chamber and the pressuring to the fresh fuel/air mixtures in the firing chamber; fuel ignition means for igniting a compressed fuel/air mixture in the firing chamber; at least a portion of the elongated cylinder inner walls extending downwardly into the gas compression chamber and adapted to house at least a portion of the piston means therein during the full downstroke of the piston means; the upper portion of the crankcase housing having inwardly sloping walls to define a converging gas space in the upper portion of the gas compression chamber annularly about the downwardly extending cylinder portion.

9 Claims, 3 Drawing Figures

INTERNAL COMBUSTION ENGINE (JV-1)

CROSS REFERENCE TO RELATED APPLICATION

This application is related to co-pending application Ser. No. 06/674,944, filed Nov. 26, 1984, entitled "Improved Two-Piston Internal Combustion Engine".

FIELD OF THE INVENTION

This invention relates generally to the field of internal combusion engines, and more particularly to two-stroke internal combustion engines.

DESCRIPTION OF THE PRIOR ART

U.S. Pat. No. 1,292,322 is directed to a water cooled two cycle gas engine provided with a dual walled cylinder having a lower, rotatably mounted perforated valve member for gas entry and accuated by a first cam and spring/rocker arm arrangement. Gases exhaust through an upper reciprocating sleeve valve member controlled by a cam movably connected to the shaft to which the cylinder's piston connecting rod is also connected.

U.S. Pat. No. 1,540,286 relates to an internal combustion piston engine provided with exhaust valves located in the upper portion of the cylinder. The engine is also provided with either a rotary gas inlet or a crankcase gas inlet valve communicating with a crankcase gas pressuring chamber.

U.S. Pat. No. 2,337,245 discloses an internal combustion engine of the two stroke type having a set of gas inlet ports at one end of the cylinder and a set of gas exhaust ports at the other cylinder end. Each set of gas ports is opened and closed by means of a separate reciprocating piston which is positioned in the cylinder.

U.S. Pat. No. 2,516,708 relates to a single-acting two-stroke cyclic internal combustion engine having an associated air scavenging chamber adjacent to the gas inlet end of the cylinder.

U.S. Pat. No. 2,572,768 also relates to a two-stroke internal combustion engine having gas inlet ports providing swirling motion by tangential gas injection arrangements.

U.S. Pat. No. 4,004,557 discloses a piston-cylinder assembly having a cup-like upper extension of the piston, and a plurality of vertical passages between the crankcase and the cylinder.

SUMMARY OF THE INVENTION

Figures 1, 2, 3:
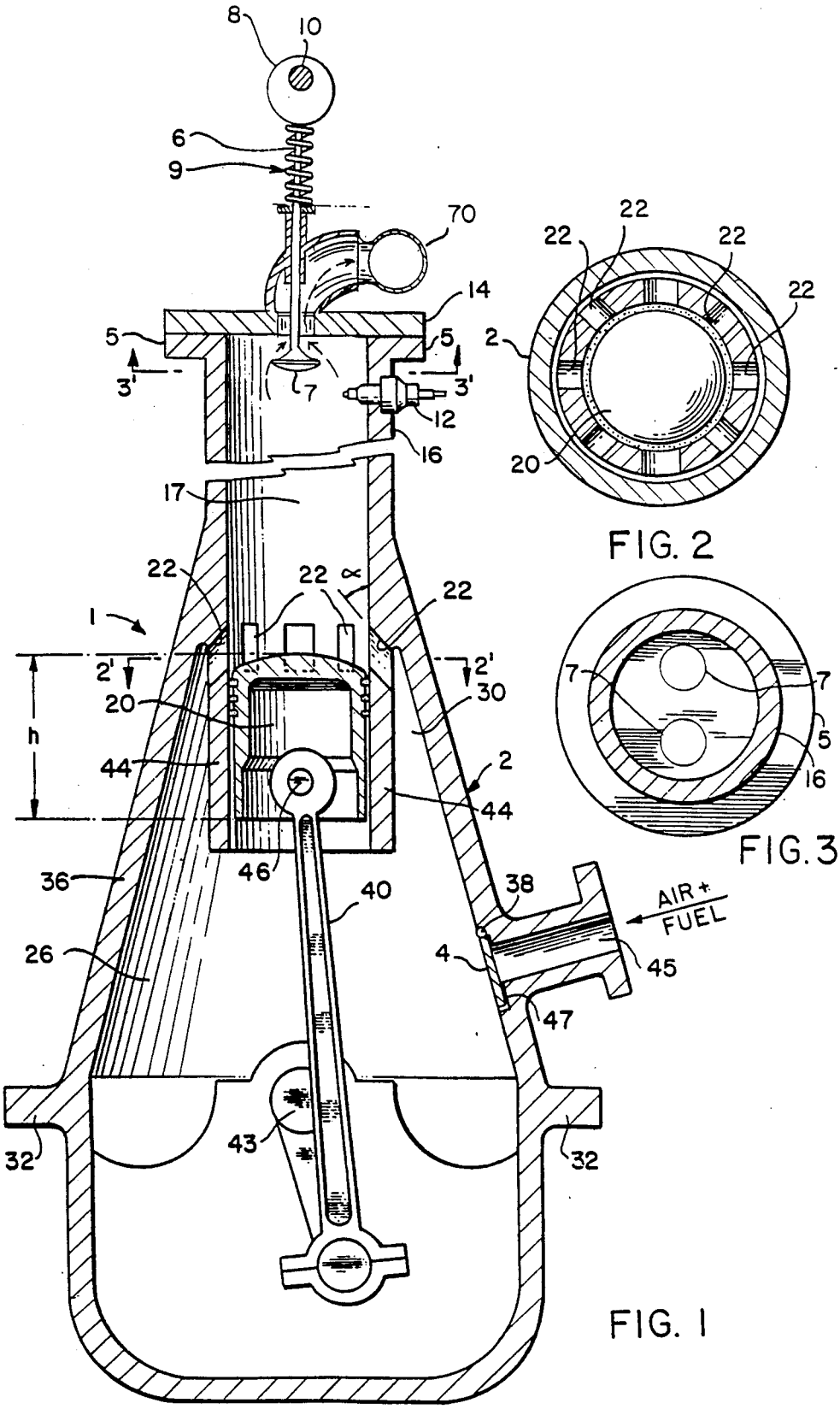
FIG. 1 is a vertical cross-sectional view of one embodiment of this invention's internal combustion engine, with a single cylinder thereof being illustrated.
FIG. 2 is an enlarged horizontal cross-sectional view of the cylinder of FIG. 1 taken along line 2'—2' in FIG. 1.
FIG. 3 is an enlarged horizontal cross-sectional view of the cylinder of FIG. 1 taken along line 3'—3' in FIG. 1.

An internal combustion engine cylinder assembly comprising an elongated cylinder having substantially vertically disposed interior walls defining an elongated firing chamber therein; piston means housed within the firing chamber and adapted for vertical reciprocation within the firing chamber; gas inlet channels in the lower portion of the firing chamber; a crankcase housing having a gas compression chamber disposed therein; a reed valve means pivotally secured to the inner walls of the gas compression chamber and adapted for passing fuel/air mixtures into the gas compression chamber upon the depressuring thereof; a cylinder closure means positioned at the upper end of the cylinder defining the upper end of the firing chamber and being provided with exhaust gas valve means, adapted for cyclic opening and closing to alternatively permit the removal of exhaust gases from the firing chamber and the pressuring to the fresh fuel/air mixtures in the firing chamber; fuel ignition means for igniting a compressed fuel/air mixture in the firing chamber; at least a portion of the elongated cylinder inner walls extending downwardly into the gas compression chamber and adapted to house at least a portion of the piston means therein during the full downstroke of the piston means; the upper portion of the crankcase housing having inwardly sloping walls to define a converging gas space in the upper portion of the gas compression chamber annularly about the downwardly extending cylinder portion, the gas inlet channels providing gaseous communication between the firing chamber and the converging gas space, and the piston means being arranged to cyclically open and close the gas inlet channels to control the gaseous communication; the piston means cooperating with the exhaust valve means and the fuel ignition means for controlling the pressurization and charging of fresh fuel/air mixtures into the firing chamber from the converging gas space and the compression of the fuel/air mixtures and the ignition thereof in the firing chamber to generate power and to remove from the firing chamber the thus generated exhaust gases.

DETAILED DESCRIPTION OF THE INVENTION

Referring to FIGS. 1, 2 and 3, a single cylinder of an engine of this invention is illustrated. It will be understood that engines of this invention can comprise a single such engine cylinder, or a multiple of such cylinders, all the cylinders of said engine being the same in principle and mechanism, the particular engine shown being of especially light construction and designed for use in motorcycles, boats, electrical generators and the like.

As illustrated, the engine is air cooled, as is preferred, although it will be understood that water or oil cooling can be provided, if desired, by provision of a suitable jacket about at least a portion of cylinder 16 to contain the selected cooling fluid and to maintain such fluid in a wall cooling relationship in contact with the outer walls of cylinder 16.

As illustrated, my engine, indicated generally at 1, comprises a crankcase housing 2 which is provided with a suitable engine mounting means 32 and which is associated with a crankshaft 43 and a connecting piston rod 40, which is in turn rotatably connected to a piston 20 by means of wrist pin 46.

A gas compression chamber 26 is provided within the upper portion 36 of crankcase housing 2 which is in cyclic gas communication with gas inlet 45. Inlet 45 is opened and closed by means of reed valve 4 positioned in a recessed portion 47 of the inner walls of crankcase housing 2. Reed valve 4 is pivoted at 38 for pivotal motion inwardly into compression chamber 26 to permit gas flow thereinto when the gas pressure in chamber 26 is less than the gas pressure in passage 45. Reed valve 4 is prevented from pivoting into passage 45 upon pressuring of gas chamber 26 by suitably sizing recessed portion 47 to securely seat valve 4 therein when valve 4 is in the closed position (as shown in FIG. 1) and the fit of valve 4 within recessed portion 47 should be such as to substantially prevent the backflow of gases from gas chamber 26 into passage 45 when chamber 26 is pressured, as will be described in more detail below. Reed valve means 4 can also be constructed as any other unit any elongated valve member, known in the art, which is positioned as shown in FIG. 1 for bending motion inwardly into gas chamber 26.

Cylinder 16 comprises an elongated, hollow, substantially cylindrical member adapted to house therein an elongated firing chamber 17 and piston 20 within chamber 17 so as to permit piston 20 to vertically reciprocate in firing chamber 17.

At least a portion of the cylinder, indicated at 44, projects downwardly into gas chamber 26, to house at least a portion of piston 20 at its lowest (downstroke) point. Preferably, the length of wall portion 44 thus positioned will range from about 0.1 to 2 times the height "h" of piston 20, and more preferably from about 0.4 to 1.5 times such height "h". However, such dimensions are only preferred and other lengths of wall portion 44 can also be used.

Cylinder 16 is securely affixed to crackcase housing 2 and, as is illustrated in FIG. 1, cylinder 16 and crankcase housing 2 can be formed as a unitary structure.

A plurality of spaced apart gas channels 22 are provided in the walls of cylinder 16 adjacent to lower portion 44 to permit gaseous communication between firing chamber 17 and gas compression chamber 26. The manner in which such gas channels are opened and closed will be described below. The number and precise positioning of channels 22 can vary, but preferably channels 22 are spaced evenly about the circumference of the cylinder wall portion 44 as shown in FIG. 2. The number and size of such channels 22 is preferably selected as that which provides the maximum air flow, hence the greatest cross sectional area, consistent with the need to maintain the structural integrity of walls 16 and 44. Generally from about 2 to 20 such channels 22 will be employed, with from about 6 to 10 being preferred. Where a plurality of such channels are used, each such channel 22 will preferably have a horizontal cross sectional area (as shown in FIG. 2) which is from about 1 to 10 percent, and more preferably from about 3 to 8 percent, of the total cross sectional area of the annulus (defined in such a view, inclusive of all channels 22) of cylinder wall 16. Also, the total area of such channels 22 will generally range from about 10 to 60 percent or more, and preferably from about 25 to 45 percent, of the total cross sectional area of such cylinder wall annulus.

At the upper end of cylinder 16 is provided cylinder head plate 14 which defines the upper end of firing chamber 17. Head plate 14 can be removably secured to a circular connector plate 5, forming the upper lip of wall 16, e.g. by means of bolts (not shown). Gas exhaust means 70 are provided in head plate 14 and preferably comprise exhaust valves 7 having a tapered lower end and an elongated shaft 6 projecting upwardly through plate 14. The manner in which exhaust valves 7 are caused to open and close can vary, and preferably each valve 7 is provided with a spring 9 about shaft 6 above plate 14 and an associated cam member 8 which is in turn rotatably secured to cam shaft 10, which when rotated causes shaft 6, and hence valve head 7, to move cyclically in a vertical relationship to plate 14. Exhaust gases are permitted to escape from firing chamber 17 through cylinder head plate 14 along each shaft 6 when the associated valve 7 is in the open position (as shown in FIG. 1). If desired such gases can then be collected into a conventional exhaust manifold (e.g., via 70) which can be positioned above cylinder head plate 14.

The number and precise positioning of valve means 7 can vary, although from 1 to 4 such valves 7 will be generally sufficient for each such apparatus 1, and such valves will be generally evenly spaced apart about the circumference of the upper end of firing chamber 17 to permit the rapid removal of the exhaust gases from chamber 17 and to avoid substantial backmixing and turbulence of the exhaust gases, and hence the resulting inefficiencies in operation which have plagued prior art devices.

At least one conventional spark plug (or other fuel ignition means) is positioned in the upper portion of cylinder walls 16. Alternatively, such spark plug 12 can be positioned in head plate 14, e.g. along the center longitudinal axis of elongated firing chamber 17.

In their closed position, each valve 7 is firmly seated in a recessed portion of the inner wall of head plate 14 to prevent substantial passage of gases either from or into firing chamber 17.

At the upper end of crankcase housing 2, in accordance with the illustrated embodiment of my invention the walls of housing 2 are inwardly sloping to define upper converging gas spaces 30 within gas chamber 26 which gas spaces are positioned about lower cylinder wall portion 44. Each gas channel 22 communicates with the uppermost part of converging gas space 30, to permit rapid and efficient gas charging of chamber 17. Each such gas channel 22 is preferably substantially circular in cross section (in the direction of gas flow therethrough) and is preferably angularly disposed such that the center longitudinal axis of each channel 22 forms an angle "$\alpha$" with the vertical, inner wall of chamber 17, of from about 10 to 60 degrees, most preferably of from about 30 to 50 degrees. The combination of such converging gas space 30 and angularly disposed gas inlet channels 22 has been found to provide gas charging with rapid velocities and high efficiencies.

The length of firing chamber 17 is such that at the full upper stroke of piston 20 (not shown), piston 20 will not come into contact with any portion of cylinder head plate 14 or with spark plug 12 or any valve 7. At its full lower stroke piston 20 uncovers each gas inlet channel 22 to permit gaseous communication between gas compression chamber 26 (via converging gas space 30) and firing chamber 17. In turn, lower portion 44 of the cylinder wall is of a length sufficient to preferably ensure that piston 20, at its lowest point, remains fully housed within the cylindrical extension of chamber 17 formed by the inner walls of cylinder portion 44.

In the usual two-stroke operation, air and fuel (which can be premixed in the proper or desired ratio by conventional means, such as carbeurator means, fuel injection or turbocharging) are drawn into gas compression chamber 26 by means of valve 4 when piston 20 moves in its upstroke after the closing of gas channels 22, thereby depressuring chamber 26 sufficiently to permit such fresh gases to pass thereto from passage 45. In its downstroke, piston 20 pressurizes the gases trapped in chamber 26 upon closing of valve 4. Upon reaching a lower point in its downstroke, the upper surface of piston 20 uncovers, and thus opens, gas channels 22 and permits the pressurized gases to pass from converging gas space 30 through channels 22 into firing chamber 17, in which the pressure had been previously lowered as a result of the piston 20 downstroke and the opening of exhaust valves 7. Exhaust valves 7 are caused by action of cam means 8 to close after the fresh fuel/air mixture is charged into chamber 17 to permit the fresh gases to be pressured during the upstroke of piston 20. If desired, valves 7 can be permitted to remain open for a portion of the upward stroke of piston 20 to permit the lowermost gas layer (which comprises the fresh fuel/air mixture) to assist in more completely forcing the exhaust gases from chamber 17. At the desired point in the upward travel of piston 20, spark plug 12 is activated to explosively ignite the thus pressured fuel/air mixture and to thereby force piston 20 downwardly, whereupon valves 7 are open to allow the thus-formed exhaust gases to exit chamber 17. The timing and precise manner of operation of cam means 8, valves 7, spark plug 12 and piston 20 is fully conventional, and since such will be readily understood by one of ordinary skill in the art, further detailed description thereof will not be given herein.

It is to be understood that the form of my invention herein shown and described is to be taken as a preferred example of the same and that various changes in the shape, size and arrangement of parts may be resorted to without departing from the spirit of my invention, or the scope of the claims hereinafter presented.

I claim:

1. An internal combustion engine cylinder assembly comprising an elongated cylinder having substantially vertically disposed interior walls defining an elongated firing chamber therein; piston means housed within said firing chamber and adapted for vertical reciprocation within said firing chamber; gas inlet channels in the lower portion of said firing chamber; a crankcase housing having a gas compression chamber disposed therein; a reed valve means pivotally secured to the inner walls of said gas compression chamber and adapted for passing fuel/air mixtures into the gas compression chamber upon the depressuring thereof; a cylinder closure means positioned at the upper end of said cylinder defining the upper end of said firing chamber and being provided with exhaust gas valve means, adapted for cyclic opening and closing to alternatively permit the removal of exhaust gases from said firing chamber and the pressuring of said fresh fuel/air mixtures in said firing chamber; fuel ignition means for igniting a compressed fuel/air mixture in said firing chamber; at least a portion of said elongated cylinder inner walls extending downwardly into said gas compression chamber and adapted to house at least a portion of said piston means therein during the full downstroke of said piston means; the upper portion of said crankcase housing having inwardly sloping walls to define a substantially uniformly converging gas space in the upper portion of said gas compression chamber annularly about said downwardly extending cylinder portion, said gas inlet channels providing direct gaseous communication between said firing chamber and said converging gas space, and said piston means being arranged to cyclically open and close said gas inlet channels to control said gaseous communication; said piston means cooperating with said exhaust valve means and said fuel ignition means for controlling the pressurization and charging of fresh fuel/air mixtures into said firing chamber from said converging gas space and the compression of said fuel/air mixtures and the ignition thereof in said firing chamber to generate power and to remove from said firing chamber the thus generated exhaust gases.

2. The internal combustion engine cylinder assembly according to claim 1 wherein said downwardly extending portion of said elongated cylinder inner walls have a length of from about 0.4 to 1.5 times the height of said piston means.

3. The internal combustion engine cylinder assembly according to claim 1 wherein said gas inlet channels in said lower portion of said firing chamber are spaced evenly about the circumference of said firing chamber.

4. The internal combustion engine cylinder assembly according to claim 3 wherein a total of from about 6 to 10 of said gas inlet channels are provided about said lower circumference in said firing chamber.

5. The internal combustion engine cylinder assembly according to claim 1 wherein each said gas inlet channel is substantially circular in cross-section and is disposed such that its center longitudinal axis forms an angle of from about 10 to 60 degrees with said vertically disposed interior walls defining said elongated firing chamber.

6. An internal combustion engine cylinder assembly comprising an elongated cylinder having substantially vertically disposed interior walls defining an elongated firing chamber therein; piston means housed within said firing chamber and adapted for vertical reciprocation within said firing chamber; upwardly sloping gas inlet channel means in the lower portion of said firing chamber, the center longitudinal axis of each said gas inlet channel forming an angle of from about 10 to 60 degrees with said vertically disposed interior walls defining said elongated firing chamber, a crankcase housing having a gas compression chamber disposed therein; a reed valve means pivotally secured to the inner walls of said gas compression chamber and adapted for passing fuel/air mixtures into the gas compression chamber upon the depressuring thereof; a cylinder closure means positioned at the upper end of said cylinder defining the upper end of said firing chamber and being provided with exhaust gas valve means, adapted for cyclic opening and closing to alternatively permit the removal of exhaust gases from said firing chamber and the pressuring of said fresh fuel/air mixtures in said firing chamber; fuel ignition means for igniting a compressed fuel/air mixture in said firing chamber; at least a portion of said elongated cylinder inner walls extending downwardly into said gas compression chamber and adapted to house at least a portion of said piston means therein during the full downstroke of said piston means; the upper portion of said crankcase housing having inwardly sloping walls to define a substantially uniformly converging gas space in the upper portion of said gas compression chamber annularly about said downwardly extending cylinder portion, said gas inlet channels providing direct gaseous communication between said firing chamber and said converging gas space, and said piston means being arranged to cyclically open and close said gas inlet channels to control said gaseous communication; said piston means cooperating with said exhaust valve means and said fuel ignition means for controlling the pressurization and charging of fresh fuel/air mixtures into said firing chamber from said converging gas space and the compression of said fuel/air mixtures and the ignition thereof in said firing chamber to generate power and to remove from said firing chamber the thus generated exhaust gases.

7. The internal combustion engine cylinder assembly according to claim 6 wherein a total of from about 2 to 20 of said gas inlet channels are provided in said firing chamber's lower portion.

8. The internal combustion engine cylinder assembly according to claim 7 wherein said gas inlet channels are spaced substantially evenly about said firing chamber's lower portion.

9. The internal combustion engine cylinder assembly according to claim 8 wherein said downwardly extending portion of said elongated cylinder walls have a length of from about 0.4 to 1.5 times the height of said piston means.

* * * * *